US007967285B2

(12) United States Patent
Ohta

(10) Patent No.: US 7,967,285 B2
(45) Date of Patent: Jun. 28, 2011

(54) CARD SENDING DEVICE

(75) Inventor: Keiji Ohta, Nagano (JP)

(73) Assignee: Nidec Sankyo Corporation (JP)

( * ) Notice: Subject to any disclaimer, the term of this patent is extended or adjusted under 35 U.S.C. 154(b) by 100 days.

(21) Appl. No.: 11/961,393

(22) Filed: Dec. 20, 2007

(65) Prior Publication Data

US 2008/0157462 A1 Jul. 3, 2008

(30) Foreign Application Priority Data

Dec. 27, 2006 (JP) ..... 2006-352841

(51) Int. Cl.
*B65H 5/00* (2006.01)

(52) U.S. Cl. ..... 271/10.06; 271/121

(58) Field of Classification Search ..... 271/23, 271/35, 131, 165, 133, 145, 121, 34, 137, 271/138, 10.06, 10.08, 10.09, 10.11; 414/797.9, 414/797.4

See application file for complete search history.

(56) References Cited

U.S. PATENT DOCUMENTS 1,965,819 A * 7/1934 Allen ..... 356/237.1
3,608,891 A * 9/1971 Hannon et al. ..... 271/23
4,003,570 A * 1/1977 Yamanaka ..... 271/265.01
5,685,690 A * 11/1997 Wagner et al. ..... 414/797.7
5,772,392 A * 6/1998 Okura et al. ..... 414/797.9

FOREIGN PATENT DOCUMENTS

JP 63-97537 * 4/1988
JP 5-4277 U 1/1993
JP 9-6929 A 1/1997
JP 2001-31267 * 2/2001

OTHER PUBLICATIONS

English translation of detailed description of JP 2001-31267.*

* cited by examiner

*Primary Examiner* — Stefanos Karmis
*Assistant Examiner* — Thomas A Morrison
(74) *Attorney, Agent, or Firm* — Cantor Colburn LLP

(57) ABSTRACT

A card sending device for use with cards may include a card storage part in which a plurality of cards are stacked and stored, a gate through which a card is capable of passing to an outside of the card storage part, a sending pawl which is capable of engaging with the card to send it to the gate one by one, a pawl feeding mechanism for moving the sending pawl, a sending drive roller for sending the card which is sent by the sending pawl, one drive source for driving the pawl feeding mechanism and the sending drive roller together and a transmission mechanism for transmitting a driving force of the drive source to the pawl feeding mechanism and the sending drive roller so that a sending speed for the card by the sending drive roller is set to be faster than a sending speed for the card by the sending pawl.

3 Claims, 6 Drawing Sheets

CARD SENDING DEVICE

CROSS REFERENCE TO RELATED APPLICATION

The present invention claims priority under 35 U.S.C. §119 to Japanese Application No. 2006-352841 filed Dec. 27, 2006, which is incorporated herein by reference.

FIELD OF THE INVENTION

An embodiment of the present invention may relate to a card sending device for sending a card in a prescribed direction.

BACKGROUND OF THE INVENTION

A card sending device has been conventionally known which is provided with a hopper (card storage part) in which cards such as a magnetic card are stacked and stored and, in which a card stored in the hopper is sent out to the outside. One of this type of card sending devices has been proposed which is provided with first rollers for sending a card out from a hopper and second rollers whose carrying speed is faster than that of the first rollers for pulling out a card which is carried out from the hopper (see, for example, Japanese Utility Model Laid-Open No. Hei 5-4277).

In the structure like the card sending device described in Japanese Utility Model Laid-Open No. Hei 5-4277 in which a card is sent out from a hopper by using the rollers (the first rollers in this Reference), slip occurs between the roller and a card face which varies a carrying force for the card; thus it is difficult to stably send out a card from the hopper. On the other hand, another card sending device which is capable of stably sending out a card from a hopper has been proposed which is provided with a card sending pawl for sending a card from a hopper and rollers for pulling out the card that is sent out by the card sending pawl (see, for example, Japanese Patent Laid-Open No. Hei 9-6929). In the card sending device described in this Patent Reference, a motor for driving the card sending pawl and a motor for driving the roller are provided separately.

As described above, in the card sending device described in Japanese Patent Laid-Open No. Hei 9-6929, a card is capable of being stably sent out from a hopper. However, in this card sending device, the card sending pawl and the roller are driven with separate motors and thus a structure of the card sending device becomes complicated. Further, when characteristics of a motor are varied due to temperature variation or the like, a sending speed of a card by the card sending pawl and a sending speed of the card by the roller are varied. Therefore, unless a rotational speed of the motor for driving the card sending pawl and a rotational speed of the motor for driving the roller are detected to adjust the rotational speeds of the respective motors, appropriate sending out of the card may be difficult. Accordingly, in order to appropriately send out a card, rotational speeds of the respective motors are required to detect and thus a structure and control of the card sending device become complicated.

SUMMARY OF THE INVENTION

In view of the problems described above, an embodiment of the present invention may advantageously provide a card sending device which is capable of stably sending a card from a card storage part with a simple structure.

Thus, according to an embodiment of the present invention, there may be provided a card sending device including a card storage part in which a plurality of cards are stacked and stored, a gate through which a card stored in the card storage part is capable of passing to an outside of the card storage part, a sending pawl which is capable of engaging with the card to send the card which is stored in the card storage part to the gate one by one, a pawl feeding mechanism for moving the sending pawl, a sending drive roller for sending the card which is sent by the sending pawl, one drive source for driving the pawl feeding mechanism and the sending drive roller together; and a transmission mechanism for transmitting a driving force of the drive source to the pawl feeding mechanism and the sending drive roller so that a sending speed for the card by the sending drive roller is set to be faster than a sending speed for the card by the sending pawl.

The card sending device in accordance with an embodiment of the present invention is provided with a sending pawl which is capable of engaging with the card stored in the card storage part to send the card to the gate one by one. Therefore, a stable carrying force for a card is obtained by the sending pawl and thus the card can be stably sent from the card storage part. Further, the card sending device in accordance with an embodiment of the present invention is provided with one drive source for driving the pawl feeding mechanism and the sending drive roller together. Therefore, the structure and control of the card sending device can be simplified.

In addition, the card sending device in accordance with an embodiment of the present invention is provided with a transmission mechanism for transmitting a driving force of the drive source to the pawl feeding mechanism and the sending drive roller so that a sending speed for the card by the sending drive roller is set to be faster than a sending speed for the card by the sending pawl. Therefore, even when the pawl feeding mechanism and the sending drive roller are driven by the one drive source, a condition where the card being sent by the sending drive roller is prevented from being pressed by the sending pawl. In other words, a state where the card is pressed against the sending drive roller by the sending pawl can be prevented. As a result, occurrence of damage of the card is prevented and the card can be sent out adequately.

In accordance with an embodiment of the present invention, a speed ratio which is a ratio between the sending speed for the card by the sending drive roller and the sending speed for the card by the sending pawl is set so that a rear edge of the card which is sent by the sending drive roller has been passed through the sending drive roller before the sending pawl which has finished sending of the card is reached to a waiting position for next sending of the card.

According to the structure as described above, a card is sent adequately and control of the drive source can be simplified. For example, as a comparison example, in a case that a sending pawl reaches to a waiting position before the rear edge of a card has been passed through the sending drive roller, when the drive source is stopped at the time of reaching of the sending pawl to the waiting position, a card cannot be sent adequately. On the other hand, in this case, when the drive source is stopped at the time of detecting the rear edge of the card having passed through the sending drive roller, the sending pawl has passed through the waiting position. Therefore, control for returning the sending pawl to the waiting position is required and thus control for the drive source becomes complicated. However, in accordance with the embodiment of the present invention, since the speed ratio is set as described above, a card can be sent adequately and control for returning the sending pawl to the waiting position is not required and thus control of drive can be simplified.

In accordance with an embodiment of the present invention, the sending pawl is structured so as to be capable of protruding to an inside of the card storage part from an abutting face of the card storage part with which a face of the card sent by the sending pawl is abutted to engage with the card, and the sending pawl is structured so as to be capable of retreating to an outer side of the card storage part, and a speed ratio which is a ratio between the sending speed for the card by the sending drive roller and the sending speed for the card by the sending pawl is set so that the sending pawl has been retreated to the outer side of the card storage part before the rear edge of the card sent by the sending drive roller has passed through the gate.

According to the structure as described above, clogging of a card at the gate, i.e., occurrence of so-called card jamming can be prevented. Further, occurrence of damage of a card which is stored in the card storage part can be restrained. In other words, in a case that the sending pawl is retreated to the outer side of the card storage part after the rear edge of the card sent by the sending drive roller has passed through the gate, when the rear edge of the card sent by the sending drive roller has passed through the gate, the card which is to be sent next is abutted with the sending pawl which protrudes in the card storage part from its abutting face. Therefore, the next card is sent to the gate and, as a result, a possibility of occurring of a card jamming is increased. Further, when the rear edge of the card sent by the sending drive roller has passed through the gate, an abutting force between the card to be sent next and the sending pawl becomes larger and thus a possibility of damage occurred on the surface of the card by the moving sending pawl becomes higher. However, in accordance with the embodiment of the present invention, the speed ratio is set as described above. Therefore, the card sent by the sending drive roller is passing through the gate and thus the gate is blocked with the card. Accordingly, the next card is not sent to the gate. As a result, occurrence of card jamming can be prevented. Further, the abutting force between the card to be sent next and the sending pawl which protrudes in the card storage part from its abutting face can be restrained less than a specified force and thus occurrence of damage of the card stored in the card storage part can be restrained.

In accordance with an embodiment of the present invention, the card sending device is provided with a card detection device for detecting the card which has passed through the gate. According to the structure as described above, sending of next card can be started after a card being sent has passed through the gate surely. Therefore, clogging of a card in the card sending device can be prevented.

In accordance with an embodiment of the present invention, the pawl feeding mechanism is provided with a chain with which the sending pawl is connected and a pair of sprockets, and the transmission mechanism is provided with a first pulley for rotationally driving one of the pair of sprockets and a second pulley for driving the sending drive roller, and the sending speed for the card by the sending drive roller is set to be faster than the sending speed for the card by the sending pawl which is connected with the chain. In this case, it is preferable that the first pulley is fixed to one of rotation shafts of the pair of sprockets, and the second pulley is fixed to a rotation shaft of the sending drive roller, and a pitch circle diameter of the second pulley is set to be smaller than a pitch circle diameter of the first pulley. According to the structure as described above, a card can be stably sent from the card storage part with a simple structure by using the chain, the sprockets, the first pulley and the second pulley.

Other features and advantages of the invention will be apparent from the following detailed description, taken in conjunction with the accompanying drawings that illustrate, by way of example, various features of embodiments of the invention.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which:

FIG. 5(A) shows a state where a front edge of a card has not reached to the sending rollers and the card is being sent by the sending pawl and FIG. 5(B) shows a state where, after the front edge of the card has reached to the sending rollers, the card is being sent by the sending rollers.

FIG. 6(A) shows a state just before a rear edge of a card has passed through a gate and FIG. 6(B) shows a state just before the rear edge of the card has passed through the sending rollers.

DETAILED DESCRIPTION OF THE PREFERRED EMBODIMENTS

An embodiment of the present invention will be described below with reference to the drawings.

Figure 1:
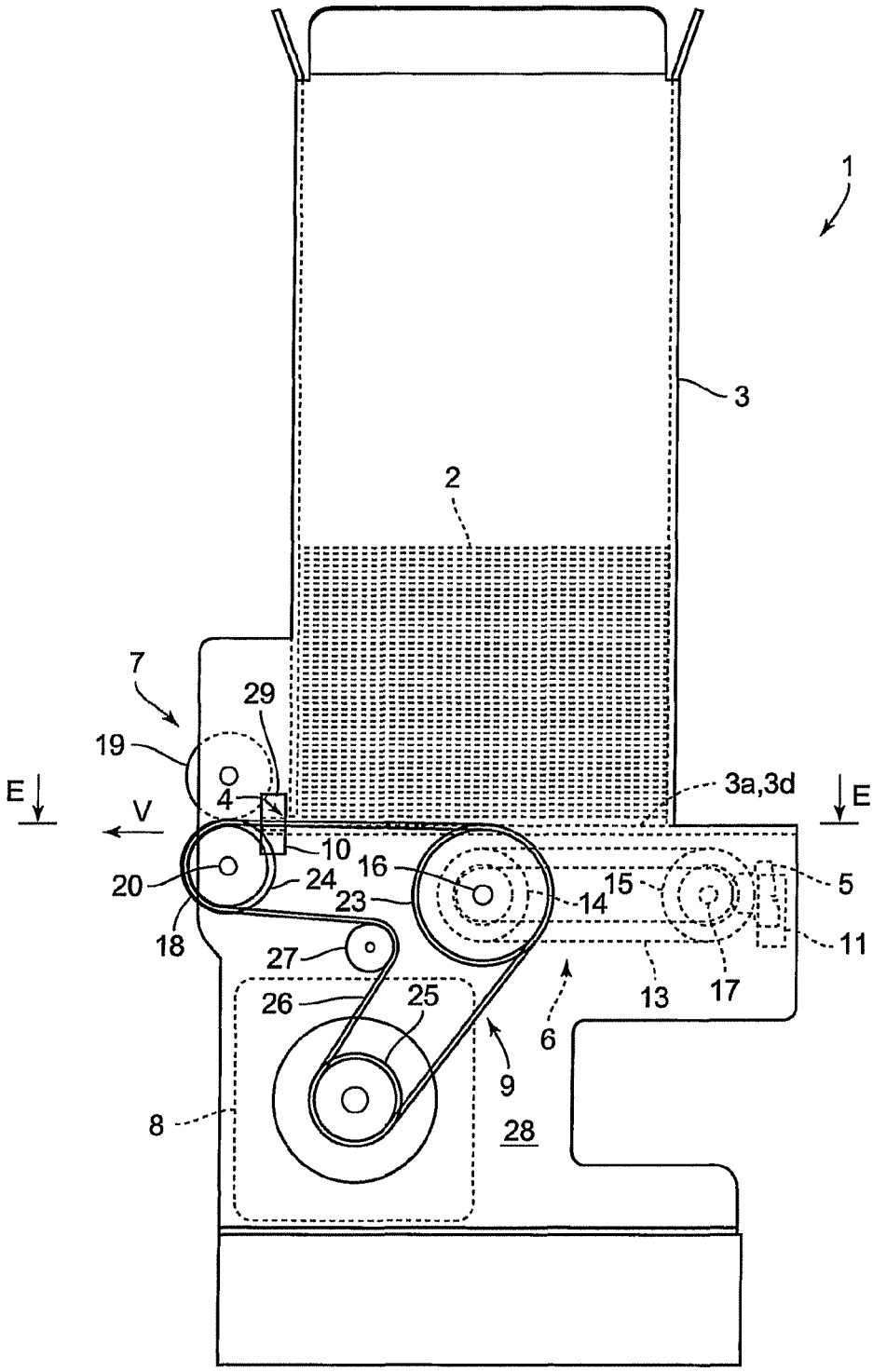
FIG. 1 is a side view showing a card sending device in accordance with an embodiment of the present invention.
Figure 2:
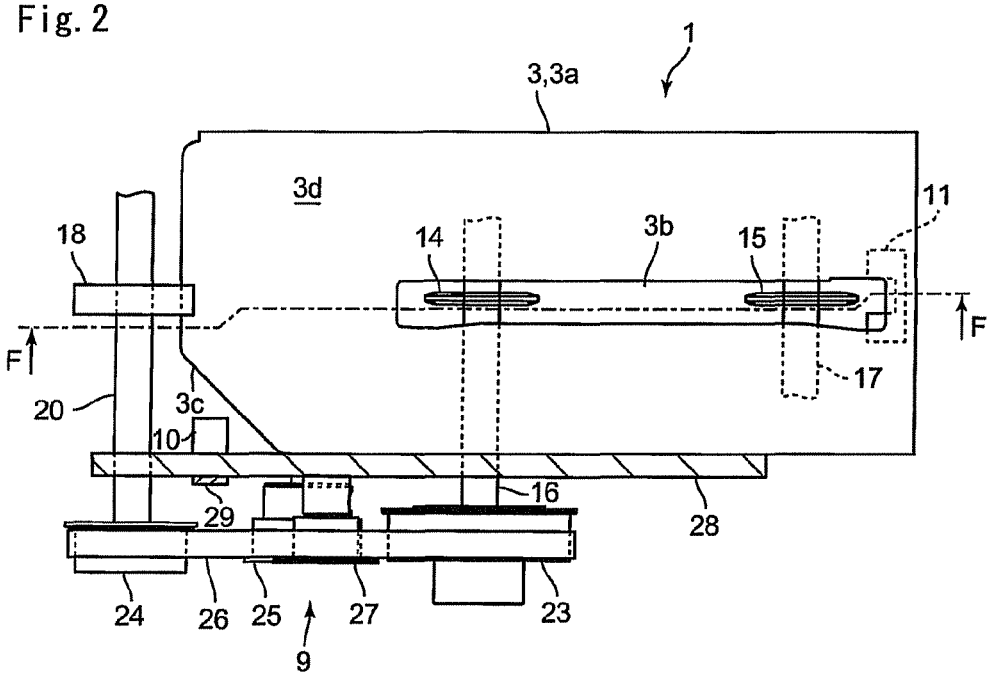
FIG. 2 is a plan view for explaining a structure of a transmission mechanism which is viewed in the "E-E" direction in FIG. 1.
Figure 3:
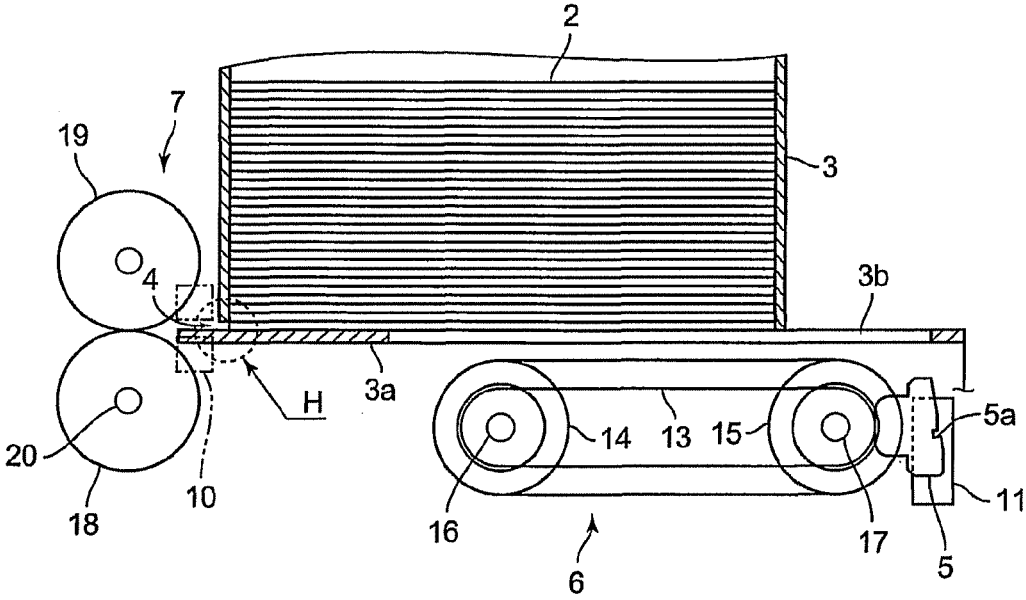
FIG. 3 is a schematic side view showing a schematic structure of the card sending device which is viewed in the "F-F" direction in FIG. 2.
Figure 4:
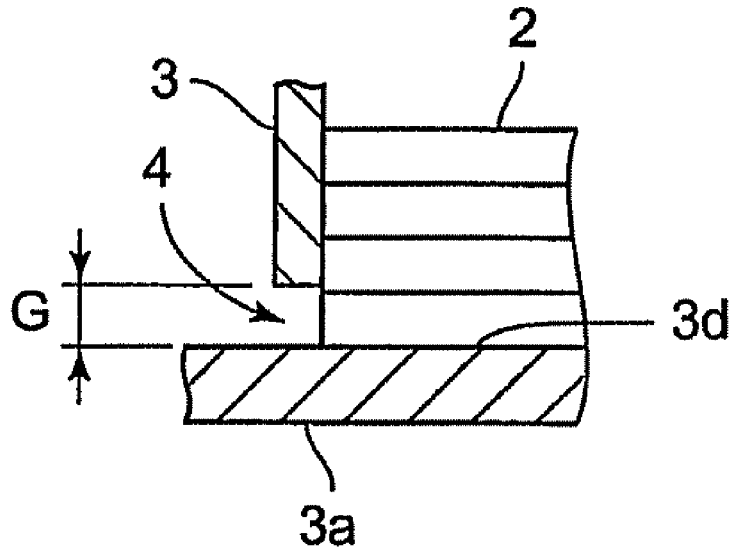
FIG. 4 is an enlarged view showing the "H" part in FIG. 3.

FIG. 1 is a side view showing a card sending device 1 in accordance with an embodiment of the present invention. FIG. 2 is a plan view for explaining a structure of a transmission mechanism 9 which is viewed in the "E-E" direction in FIG. 1. FIG. 3 is a schematic side view showing a schematic structure of the card sending device 1 which is viewed in the "F-F" direction in FIG. 2. FIG. 4 is an enlarged view showing the "H" part in FIG. 3.

A card sending device 1 in accordance with an embodiment of the present invention is a device in which a card 2 stored inside is sent in a predetermined direction. For example, the card sending device 1 sends a card 2 out to a card reader where information recorded on the card 2 is reproduced or specified information is recorded on the card 2, or to a printer which prints on the surface of the card 2. Alternatively, for example, the card sending device 1 is used in a vending machine of a card 2 in which a card 2 is sent out so as to be dropped to a card takeout port of the vending machine. The card sending device 1 in this embodiment sends out the card 2 in a direction shown by the arrow "V" in FIG. 1.

In the following descriptions, a front side of the paper in FIG. 1 is referred to as "front", a back side of the paper in FIG. 1 is referred to as "back", a left side in FIG. 1 is "left", a right side in FIG. 1 is "right", an upper side in FIG. 1 is "upper", and a lower side in FIG. 1 is "lower". Further, as described above, in the card sending device 1, in order to send a card 2 out in the direction shown by the arrow "V" in FIG. 1, a left side edge of the card 2 is referred to as "front edge" and its right side edge is referred to as "rear edge".

As shown in FIG. 1 through FIG. 4, the card sending device 1 includes a card storage part 3 in which a plurality of cards 2 is stacked and stored, a gate 4 through which a card 2 stored in the card storage part 3 is passed toward an outside of the card storage part 3, a sending pawl 5 which is capable of engaging with the card 2 stored in the card storage part 3 to send out the card 2 to the gate 4 one by one, a pawl feeding mechanism 6 for moving the sending pawl 5, sending rollers 7 for sending out the card 2 which is sent by the sending pawl 5, a motor 8 as a drive source for driving the pawl feeding mechanism 6 and the sending rollers 7 together, and a transmission mechanism 9 for transmitting a driving force of the motor 8 to the pawl feeding mechanism 6 and the sending rollers 7.

Further, the card sending device 1 also includes a card detection device 10 for detecting a card 2 which is passing through the gate 4 and a waiting position detection device 11 for detecting the sending pawl 5 which is positioned at a predetermined waiting position to be capable of sending a next card 2.

The card 2 in this embodiment is, for example, a rectangular card made of vinyl chloride with a thickness of about 0.7-0.8 mm. The card 2 may be formed on its surface with a magnetic stripe in which magnetic information is recorded or the card 2 may be provided with IC contacts on its surface. Further, an antenna for communication may be provided within the card 2 and a printing part on which printing is performed by using a thermal method may be formed on the surface of the card 2. In addition, the card 2 may be a PET (poly ethylene terephthalate) card with a thickness of about 0.18-0.36 mm or may be a paper card.

The card storage part 3, which is formed in a rectangular parallelepiped box shape whose upper face is opened, is disposed at an upper side portion of the card sending device 1. A width in a front and rear direction of the inside of the card storage part 3 is slightly wider than a width in a short side direction of the card 2, and a width in a right and left direction of the inside of the card storage part 3 is slightly wider than a width in a long side direction of the card 2. Further, as shown in FIG. 3, a bottom face part 3*a* which forms a bottom face of the card storage part 3 is formed so as to protrude to the right side from a right side wall of the card storage part 3.

As shown in FIG. 2, the bottom face part 3*a* is formed with a passage hole 3*b* through which the sending pawl 5 is passed and a chamfered part 3*c* for disposing the card detection device 10. The passage hole 3*b* is formed in an elongated roughly rectangular shape whose long side direction is the right and left direction in FIG. 2 and formed so as to penetrate the bottom face part 3*a* in a vertical direction. Further, the passage hole 3*b* is formed in the bottom face part 3*a* at a roughly center position in the front and rear direction of the bottom face part 3*a* and, in the right and left direction, is formed over a predetermined range from a position close to its right-side edge. The chamfered part 3*c* is formed at a corner part in the front edge and the left edge of the bottom face part 3*a*.

On an upper face of the uppermost card 2 of a plurality of cards 2 which is stored in the card storage part 3, for example, a weight (not shown) having a predetermined weight is placed and the card 2 (the lowest card 2) which is stored at the lowermost position is abutted with the bottom face part 3*a* with a predetermined force. In this embodiment, an upper face 3*d* of the bottom face part 3*a* is an abutting face in the card storage part 3 with which a card 2 carried out by the sending pawl 5 is abutted (hereinafter, referred to as "abutting face 3*d*").

As shown in FIG. 4, the gate 4 is formed between a left side wall of the card storage part 3 and the bottom face part 3*a*. A gap space "G" in a vertical direction of the gate 4 is larger than a thickness of a card 2 and is smaller than a thickness of two cards 2 which are stacked. In other words, the gap space "G" is set to be a distance through which one piece of a card 2 can be passed but two pieces of stacked cards 2 cannot be passed.

As shown in FIG. 3, the sending pawl 5 is provided with an engagement part 5*a* for engaging with a rear edge of a card 2 and is fixed to a chain 13 described below for structuring the pawl feeding mechanism 6.

The pawl feeding mechanism 6 is provided with the chain 13 to which the sending pawl 5 is fixed and a pair of sprockets 14 and 15 along which the chain 13 is stretched. As shown in FIGS. 2 and 3, the sprockets 14 and 15 are disposed on an under side of the passage hole 3*b*. Further, the sprocket 14 which is disposed on the left side is rotated together with a rotation shaft 16 and the sprocket 15 which is disposed on the right side is rotated together with the rotation shaft 17.

When the sprockets 14 and 15 are rotated, the sending pawl 5 is reciprocated between the sprockets 14 and 15 together with the chain 13. In this embodiment, under a normal operation, the sprockets 14 and 15 are rotated in a counterclockwise direction in FIG. 3. Therefore, when the sending pawl 5 is moved from the sprocket 15 to the sprocket 14 (moved from the right side to the left side), the sending pawl 5 is passed on the upper side of the sprockets 14 and 15. Further, when the sending pawl 5 is moved from the left side to the right side, the sending pawl 5 is passed on the under side of the sprockets 14 and 15.

More specifically, when the sending pawl 5 is moved to the left side from the right side, the sending pawl 5 is disposed within the passage hole 3*b* and the engagement part 5*a* is protruded on an upper side from the abutting face 3*d* to abut with the rear edge of the lowermost card 2. Then, the sending pawl 5 sends the lowermost card 2 to the gate 4. Further, in this embodiment, when the sending pawl 5 is moved to the right side from the left side, the sending pawl 5 is passed on the under side of the abutting face 3*d*. In other words, the sending pawl 5 can be retreated on the outer side (specifically, on the under side) of the card storage part 3.

The sending rollers 7 include a sending drive roller 18 which is disposed on the lower side and a pad roller 19 which abuts with the sending drive roller 18 from the upper side. They are disposed on the left side of the card storage part 3. The sending rollers 7 send out a card 2 to the left direction under a state where the card 2 is sandwiched between the sending drive roller 18 and the pad roller 19. The sending drive roller 18 is connected with the motor 8 through the transmission mechanism 9 and is rotated together with the rotation shaft 20. The pad roller 19 is urged to the sending drive roller 18 by an urging member such as a spring (not shown) and is rotated with the sending drive roller 18.

As shown in FIG. 1, the motor 8 is disposed on the under side of the card storage part 3. The motor 8 in this embodiment is a stepping motor. However, the motor 8 may be a DC motor.

The transmission mechanism 9 includes a first driven pulley 23 as a first pulley, which is fixed to a front end of the rotation shaft 16 of the sprocket 14, a second driven pulley 24 as a second pulley, which is fixed to a front end of a rotation shaft 20 of the drive roller 18, a drive pulley 25 which is fixed to a front end of an output shaft of the motor 8, a timing belt 26 which is stretched over these pulleys, and a tension pulley 27 for adjusting tension of the timing belt 26.

The transmission mechanism 9 is disposed on the under side of the card storage part 3 in the vertical direction. Further, the transmission mechanism 9 is disposed on the front side of the card sending device 1 in the front and rear direction. Specifically, as shown in FIG. 2, the transmission mechanism 9 is disposed on the front side of a front wall 28 of the card sending device 1. The tension pulley 27 is movably mounted on the front wall 28 so as to be capable of adjusting the tension of the timing belt 26.

The card detection device 10 is an optical detection device which is provided with a light emitting element (not shown) and a light receiving element (not shown), which are faced each other in the vertical direction, and a circuit board 29 which is fixed to the front wall 28. The card detection device 10 is disposed between the gate 4 and the sending rollers 7 in the right and left direction. Further, the card detection device 10 is disposed in the vertical direction so that a card 2 can be passed between the light emitting element and the light receiving element.

A waiting position detection device 11 is an optical detection device which is provided with a light emitting element (not shown) and a light receiving element (not shown), which are faced each other in the front and rear direction, and a circuit board (not shown). The waiting position detection device 11 is disposed in the front and rear direction so that the sending pawl 5 can be passed between the light emitting element and the light receiving element. As shown in FIG. 3 and the like, the waiting position detection device 11 is disposed on the right side of the sprocket 15 and on the under side of the bottom face part 3*a*. In this embodiment, the position where the sending pawl 5 is located between the light emitting element and the light receiving element is the waiting position of the sending pawl 5. In other words, in this embodiment, as shown in FIG. 3 and the like, the waiting position of the sending pawl 5 is set to be under side of the bottom face part 3*a*.

Figure 5A:
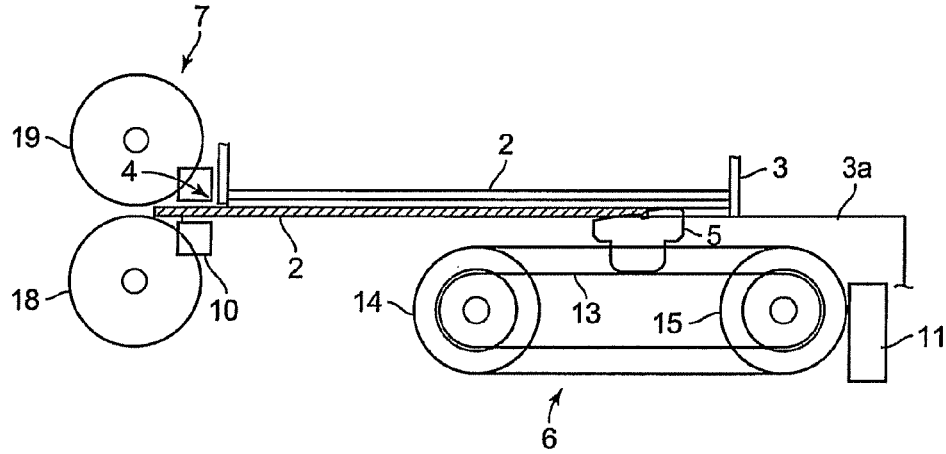
FIGS. 5(A) and 5(B) are first explanatory views for explaining a relationship between a card sending speed by sending rollers and a card sending speed by a sending pawl shown in FIG. 1.
Figure 5B:
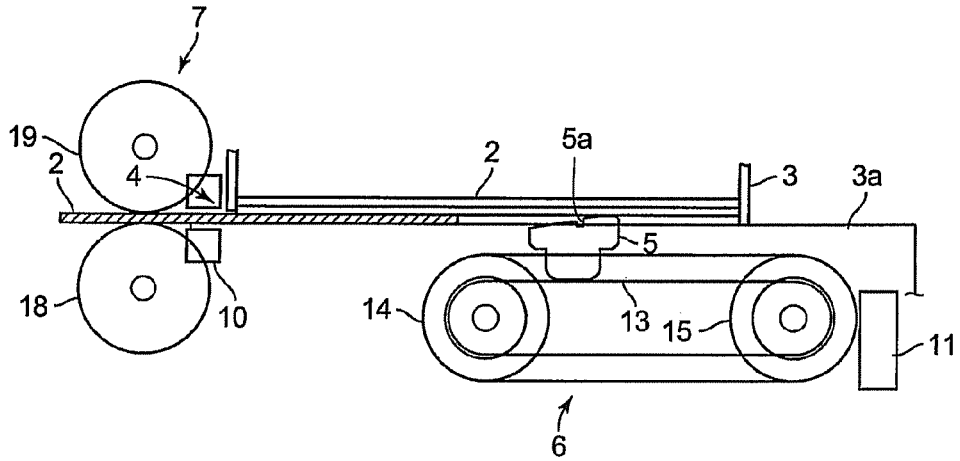
Figure 6A:
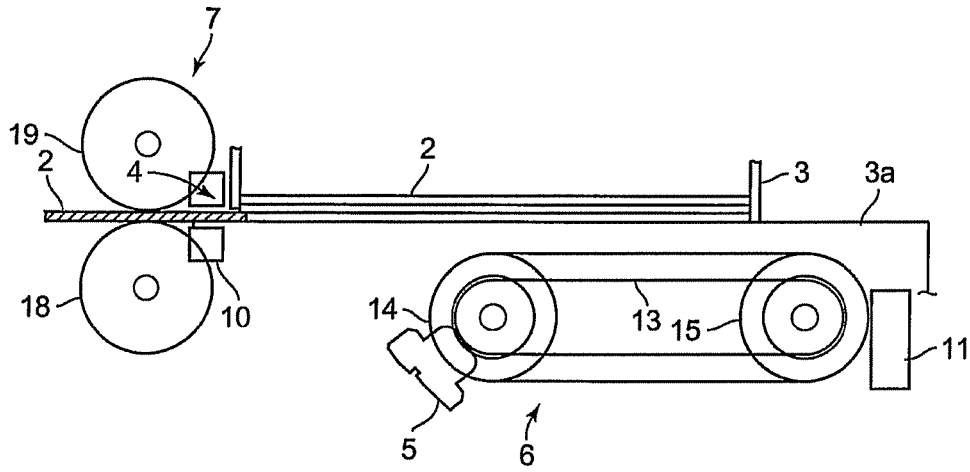
FIGS. 6(A) and 6(B) are second explanatory views for explaining a relationship between the card sending speed by sending rollers and the card sending speed by a sending pawl shown in FIG. 1.
Figure 6B:
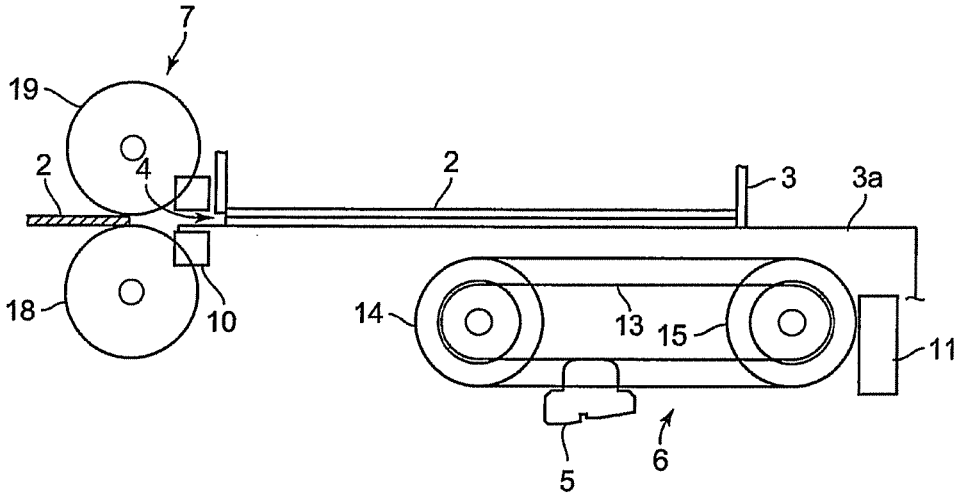

FIGS. 5(A) and 5(B) are first explanatory views for explaining a relationship between a sending speed of a card 2 by the sending rollers 7 and a sending speed of the card 2 by the sending pawl 5 shown in FIG. 1. FIG. 5(A) shows a state where a front edge of the card 2 has not reached to the sending rollers 7 and the card 2 is being sent by the sending pawl 5, and FIG. 5(B) shows a state where, after the front edge of the card 2 has reached to the sending rollers 7, the card 2 is being sent by the sending rollers 7. FIGS. 6(A) and 6(B) are second explanatory views for explaining a relationship between the sending speed of a card 2 by the sending rollers 7 and the sending speed of the card 2 by the sending pawl 5 shown in FIG. 1. FIG. 6(A) shows a state just before a rear edge of the card 2 has passed through the gate 4 and FIG. 6(B) shows a state just before the rear edge of the card 2 has passed through the sending rollers 7.

In the transmission mechanism 9 in this embodiment, a driving force of the motor 8 is transmitted to the pawl feeding mechanism 6 and the sending rollers 7 so that the sending speed of a card 2 by the sending rollers 7 is faster than the sending speed of the card 2 by the sending pawl 5.

In other words, in a state where the sending pawl 5 is located at the waiting position (state in FIG. 3), when the sprockets 14, 15 and the sending drive roller 18 to which the driving force of the motor 8 is transmitted start to rotate through the transmission mechanism 9, first, as shown in FIG. 5(A), a card 2 is sent by the sending pawl 5 until the front edge of the card 2 reaches to the sending rollers 7. In other words, until the front edge of the card 2 reaches to the sending rollers 7, the engagement part 5*a* of the sending pawl 5 has been abutted with the rear edge of the card 2 and the card 2 is sent out by the sending pawl 5.

Then, the front edge of the card 2 reaches to the sending rollers 7 and the card 2 is sandwiched between the sending drive roller 18 and the pad roller 19 and, after that, the engagement part 5*a* is separated from the rear edge of the card 2 and the card 2 is sent out only by the sending rollers 7.

Further, in this embodiment, as shown in FIG. 6(A), a speed ratio which is a ratio between the sending speed of the card 2 by the sending rollers 7 and the sending speed of the card 2 by the sending pawl 5 is set so that the sending pawl 5 is retreated on the under side of the card storage part 3 (under side of the bottom face part 3*a*) before the rear edge of the card 2 sent by the sending rollers 7 has been passed through from the gate 4.

In addition, in this embodiment, as shown in FIG. 6(B), a speed ratio between the sending speed of the card 2 by the sending rollers 7 and the sending speed of the card 2 by the sending pawl 5 is set so that the rear edge of the card 2 sent by the sending rollers 7 has passed through the sending rollers 7 before the sending pawl 5 having finished sending out the card 2 reaches to the waiting position of the sending pawl 5 where the sending pawl 5 is located between the light emitting element and the light receiving element of the waiting position detection device 11.

As described above, in this embodiment, the card sending device 1 is provided with the sending pawl 5 having the engagement part 5*a* abutting with the rear edge of the card 2 for sending out a card 2 stored in the card storage part 3 to the gate 4 one by one. Therefore, a stable carrying force for the card 2 can be obtained by the sending pawl 5 and thus the card 2 can be stably sent out from the card storage part 3.

In this embodiment, the motor 8 drives both the pawl feeding mechanism 6 and the sending rollers 7 together. Therefore, structure and control of the card sending device 1 can be simplified in comparison with a case that a motor for driving the pawl feeding mechanism 6 and a motor for driving the sending rollers 7 are provided separately. Further, in a case that a motor for the pawl feeding mechanism 6 and a motor for the sending rollers 7 are provided separately, when characteristics of the motors vary due to temperature variation, two motors are required to be individually adjusted to appropriately send out the card 2 from the card storage part 3. However, in this embodiment, these adjustments are not required. In addition, since the pawl feeding mechanism 6 and the sending rollers 7 are driven together, the card 2 can be sent out at a high speed with a simple control in which only a rotational speed of the motor 8 is increased.

In the card sending device 1 in this embodiment, a driving force of the motor 8 is transmitted to the pawl feeding mechanism 6 and the sending rollers 7 through the transmission mechanism 9 so that the sending speed of a card 2 by the sending rollers 7 is faster than the sending speed of the card 2 by the sending pawl 5. Therefore, even when the pawl feeding mechanism 6 and the sending rollers 7 are driven by the common motor 8, the rear edge of the card 2 being sent by the sending rollers 7 can be prevented from being pushed by the sending pawl 5. In other words, the card 2 sandwiched between the sending drive roller 18 and the pad roller 19 is prevented from being pressed between the sending rollers 7 and the sending pawl 5 by the sending pawl 5. Therefore, occurrence of damage of the card 2 is prevented and the card 2 can be sent out adequately.

Especially, in this embodiment, a pitch circle diameter of the second driven pulley 24 is set and formed to be smaller than a pitch circle diameter of the first driven pulley 23 and, as a result, it is structured so that a sending speed of the card 2 by the sending rollers 7 is faster than a sending speed of the card 2 by the sending pawl 5. Therefore, occurrence of damage of the card 2 is prevented and the card 2 can be sent out adequately with a simple structure.

Figure 7A:
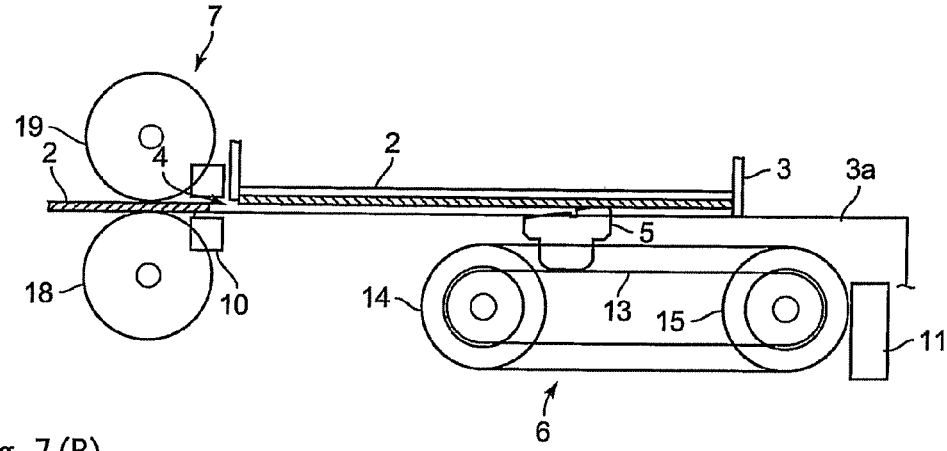
FIGS. 7(A) and 7(B) are side views for explaining an effect of the card sending device shown in FIG. 1.

In this embodiment, a speed ratio which is a ratio between the sending speed of the card 2 by the sending rollers 7 and the sending speed of the card 2 by the sending pawl 5 is set so that the sending pawl 5 has been retreated to the under side of the card storage part 3 (under side of the bottom face part 3*a*) before the rear edge of the card 2 which is being sent by the sending rollers 7 has been passed from the gate 4. Therefore, occurrence of damage of the card 2 stored in the card storage part 3 can be restrained. In other words, in a case that the sending pawl 5 is retreated on the under side of the card storage part 3 after the rear edge of the card 2 which is being sent by the sending rollers 7 has been passed from the gate 4, as shown in FIG. 7(A), when the rear edge of the card 2 sent by the sending rollers 7 has been passed through from the gate 4, an abutting force of an under face of a card 2 which is to be sent next with an upper face of the sending pawl 5 protruding upward from the abutting face 3*d* becomes larger. Therefore, a possibility becomes higher in which damage occurs on the surface of the card 2 by the sending pawl 5 which is moved to the left direction. On the other hand, when the speed ratio is set as described above, for example, as shown in FIG. 5(B), the under face of the card 2 which is to be sent next has been abutting with the upper face of the card 2 which is being sent while the upper end of the sending pawl 5 abuts with the under face of the card 2 which is to be sent next. Therefore, an abutting force of the card 2 which is to be sent out next with the sending pawl 5 can be restrained to be less than a specified force. Accordingly, occurrence of damage of the card 2 which is stored in the card storage part 3 can be restrained.

Further, when the speed ratio is set as described above, jamming of cards 2 at the gate 4 can be prevented. In other words, in a case that the sending pawl 5 is retreated to the under side of the card storage part 3 after the rear edge of the card 2 being sent by the sending rollers 7 has been passed through from the gate 4, as shown in FIG. 7(A), when the rear edge of the card 2 sent by the sending rollers 7 has been passed through from the gate 4, no card 2 is present at the gate 4. Therefore, the next card 2 may be sent to the gate 4 by a frictional force which is occurred between the card 2 which is to be sent out next and the upper face of the sending pawl 5 and, as a result, the next card 2 may be jammed at the gate 4. On the other hand, when the speed ratio is set as described above, as shown in FIG. 5(B), the card 2 which is being sent by the sending rollers 7 blocks the gate 4 while the upper face of the sending pawl 5 abuts with the under face of the card 2 which is to be sent out next. Therefore, the next card 2 is prevented from being sent by the upper face of the sending pawl 5 to the gate 4. Accordingly, jamming of cards 2 at the gate 4 can be prevented.

Figure 7B:
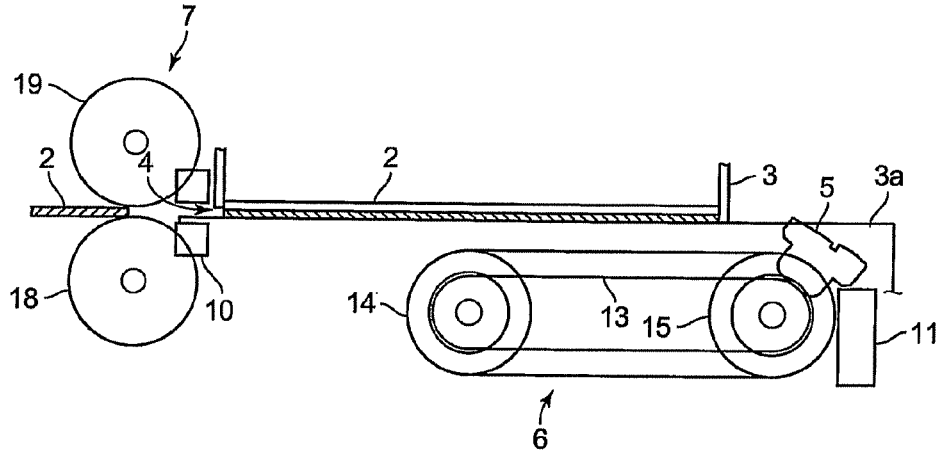

In this embodiment, a speed ratio which is a ratio between the sending speed of the card 2 by the sending rollers 7 and the sending speed of the card 2 by the sending pawl 5 is set so that the rear edge of the card 2 which is being sent by the sending rollers 7 has been passed through from the sending rollers 7 before the sending pawl 5 having finished with sending out of the card 2 reaches to a waiting position of the sending pawl 5. Therefore, the card 2 can be sent out adequately and control of the motor 8 can be simplified. In other words, in a case that the sending pawl 5 has reached to the waiting position before the rear edge of the card 2 is passed through from the sending rollers 7, when the motor 8 is stopped at the time when the sending pawl 5 has reached to the waiting position, the card 2 may not be sent out adequately. Further, in this case, when the motor 8 is stopped after detecting that the rear edge of the card 2 has been passed through from the sending rollers 7, as shown in FIG. 7(B), the sending pawl 5 is passed through the waiting position. Therefore, a control is required to return the sending pawl 5 to the waiting position and thus a control for the motor 8 becomes complicated. On the other hand, when the speed ratio is set as described above, the above-mentioned problems can be eliminated and thus the card 2 is sent out adequately and the control for the motor 8 can be simplified.

In this embodiment, the card sending device 1 is provided with a card detection device 10 for detecting a card 2 which is passed through the gate 4. Therefore, sending of the next card 2 is started after the card 2 being sent has been passed through the gate 4 securely. Accordingly, jamming of cards 2 in the card sending device 1 can be prevented.

Although the present invention has been shown and described with reference to specific embodiments, various changes and modifications will be apparent to those skilled in the art from the teaching herein.

In the embodiment described above, the pawl feeding mechanism 6 is structured of the chain 13, the sprockets 14 and 15 and the like. However, for example, the pawl feeding mechanism 6 may be structured of pulleys, a timing belt and the like.

In the embodiment described above, the transmission mechanism 9 is structured of the pulleys such as the first driven pulley 23 and the second driven pulley 24, the timing belt 26 and the like. Alternatively, for example, the transmission mechanism 9 may be structured of a chain, sprockets and the like, or may be structured of a gear train and the like. Accordingly, instead of directly rotationally driving the first driven pulley 23, the second driven pulley 24 and the like with the timing belt 26, gears and the like may be used. In this case, it may be unnecessary to structure that the pitch circle diameter of the second driven pulley 24 is set and formed to be smaller than the pitch circle diameter of the first driven pulley 25 as in the above-mentioned embodiment. For example, it may be structured that the sending speed of the card 2 by the sending rollers 7 is faster than the sending speed of the card 2 by the sending pawl 5 by changing a diameter of a gear which is connected with the sending drive roller 18.

In the embodiment described above, the card storage part 3 is disposed on the upper side portion of the card sending device 1 and the sending pawl 5, the pawl feeding mechanism 6, the sending rollers 7, the transmission mechanism 9 and the like are disposed on the under side of the card storage part 3. However, for example, it may be structured that the card storage part 3 is disposed on the under side of the card sending device 1, and the sending pawl 5, the pawl feeding mechanism 6, the sending rollers 7, the transmission mechanism 9 and the like are disposed on the upper side of the card storage part 3. In this case, cards 2 stored in the card storage part 3 are required to be urged to the upper side. Further, it may be structured that the card storage part 3 is disposed on the right side portion or the left side portion of the card sending device 1, and the sending pawl 5, the pawl feeding mechanism 6, the sending rollers 7, the transmission mechanism 9 and the like are disposed on the left side or the right side of the card storage part 3.

In the embodiment described above, the card sending device 1 is provided with the motor 8 for driving the pawl feeding mechanism 6 and the sending rollers 7 together. However, the present invention is not limited to this embodiment. For example, when the card sending device 1 is used together with a card reader, a printer or the like so that a card 2 is sent to the card reader, the printer or the like, the pawl feeding mechanism 6 and the sending rollers 7 may be driven together by using a motor which is provided in the card reader, the printer or the like.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A card sending device for use with cards comprising:

a card storage part in which a plurality of the cards are stacked and stored;

a gate through which a card stored in the card storage part is capable of passing to an outside of the card storage part;

a sending pawl which is capable of engaging with the card to send the card which is stored in the card storage part to the gate one by one;

a pawl feeding mechanism for moving the sending pawl;

a sending drive roller for sending the card which is sent by the sending pawl;

one drive source for driving the pawl feeding mechanism and the sending drive roller together; and a transmission mechanism for transmitting a driving force of the drive source to the pawl feeding mechanism and to the sending drive roller and structured so that a sending speed for the card by the sending drive roller is set to be faster than a sending speed for the card by the sending pawl;

wherein a speed ratio which is a ratio between the sending speed for the card by the sending drive roller and the sending speed for the card by the sending pawl is set so that a rear edge of the card which is sent by the sending drive roller has been passed through the sending drive roller before the sending pawl which has finished sending of the card is reached to a waiting position for next sending of a next card;

the sending pawl is structured such that when the card is being sent, an upper face of the sending pawl is abutted with an under face of the next card to be sent;

the sending pawl is structured so as to be capable of protruding to an inside of the card storage part from an abutting face of the card storage part with which a face of the card sent by the sending pawl is abutted to engage with the card;

the sending pawl is structured so as to be capable of retreating to an outer side of the card storage part;

a speed ratio which is a ratio between the sending speed for the card by the sending drive roller and the sending speed for the card by the sending pawl is set so that the sending pawl has been retreated to the outer side of the card storage part before the rear edge of the card sent by the sending drive roller has passed through the gate;

the pawl feeding mechanism is provided with a chain with which the sending pawl is connected and a pair of sprockets, the transmission mechanism is provided with a first pulley for rotationally driving one of the pair of sprockets and a second pulley for driving the sending drive roller, and the sending speed for the card by the sending drive roller is set to be faster than the sending speed for the card by the sending pawl which is connected with the chain.

2. The card sending device according to claim 1, further comprising a card detection device for detecting the card which has passed through the gate.

3. The card sending device according to claim 1, wherein the first pulley is fixed to one of rotation shafts of the pair of sprockets, and the second pulley is fixed to a rotation shaft of the sending drive roller, and a pitch circle diameter of the second pulley is set to be smaller than a pitch circle diameter of the first pulley.

* * * * *